US005329714A

United States Patent [19]

Lee

[11] Patent Number: 5,329,714

[45] Date of Patent: Jul. 19, 1994

[54] AMUSING FLOATING GADGET

[76] Inventor: Vincent K. Lee, No. 44, Lane 458, Sheh Chung Street, Taipei, Taiwan

[21] Appl. No.: 40,441

[22] Filed: Apr. 1, 1993

[51] Int. Cl.[5] ..... G09F 19/08; A63H 3/26

[52] U.S. Cl. ..... 40/409; 40/412; 40/439; 40/477; 446/159; 446/267; 446/321

[58] Field of Search ..... 446/153, 159, 160, 267, 446/321, 396; 40/409-412, 439, 477

[56] References Cited

U.S. PATENT DOCUMENTS

| | | | |
|---|---|---|---|
| 479,530 | 7/1892 | Roberts | 446/267 X |
| 909,467 | 1/1909 | Shaw | 446/267 X |
| 1,396,902 | 11/1921 | Wainala | 446/267 |
| 4,332,096 | 6/1982 | Kohner et al. | 40/409 X |
| 4,568,304 | 2/1986 | Santa Maria | 446/321 |
| 4,582,498 | 4/1986 | Tamada | 446/267 |

FOREIGN PATENT DOCUMENTS

| | | | |
|---|---|---|---|
| 619702 | 5/1961 | Canada | 446/321 |
| 451887 | 11/1927 | Fed. Rep. of Germany | 446/267 |

*Primary Examiner*—Danton D. DeMille
*Attorney, Agent, or Firm*—Bacon & Thomas

[57] ABSTRACT

A floating body disposed within a liquid-filled container has top and bottom portions provided with extensible and retractable objects, some of which have a greater buoyancy then the body and the remainder of which tend to sink in the liquid. The body and objects have various configurations and designs which create three-dimensional changes during floating of the body each time the container is turned upside-down.

3 Claims, 7 Drawing Sheets

AMUSING FLOATING GADGET

BACKGROUND OF THE INVENTION

In the past, many fluid decoration devices, including fluid hourglasses and floating and buoyant decorations, have been designed to cater to tastes of numerous consumers. However, these decorations lack originality and cannot attract consumers. Known fluid hourglass and buoyant decorations provide only monotonous change. As a result, they appear as a fad for a very short period of time. After the fad has gone, they disappear from the market.

SUMMARY OF THE INVENTION

The main purpose of the invention is to amuse customers with an interesting floating body having an exquisite structure and changeable three-dimensional scenes.

The secondary purpose of the invention is to provide a unique amusing function by offering two different three-dimensional scenes formed during the floating process.

The transparent container of the amusing floating gadget can be of any shape The container is filled with fluid and a set of floating body and objects are placed within the fluid. The floating body can be of any shape and provided with a plurality of holes on the top and bottom portions thereof. Extensible and retractable floating and sinking objects are provided in the holes. The objects can be designed to portray special scenes corresponding to outside environments. Therefore, during the floating process, various changeable three-dimensional patterns are formed to amuse the viewer.

DETAILS OF THE PREFERRED EMBODIMENT

Figure 1:
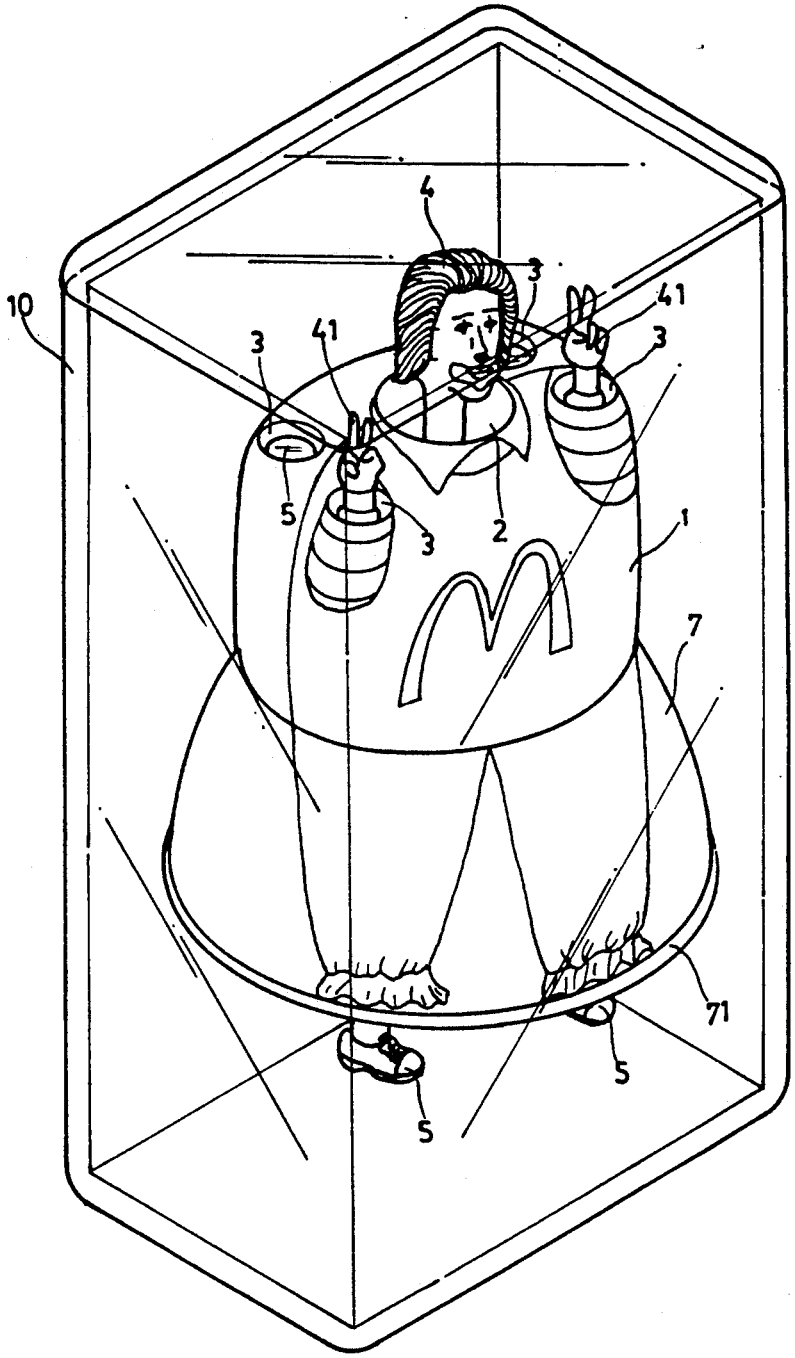
FIG. 1 is a perspective view of the invention.
Figure 2:
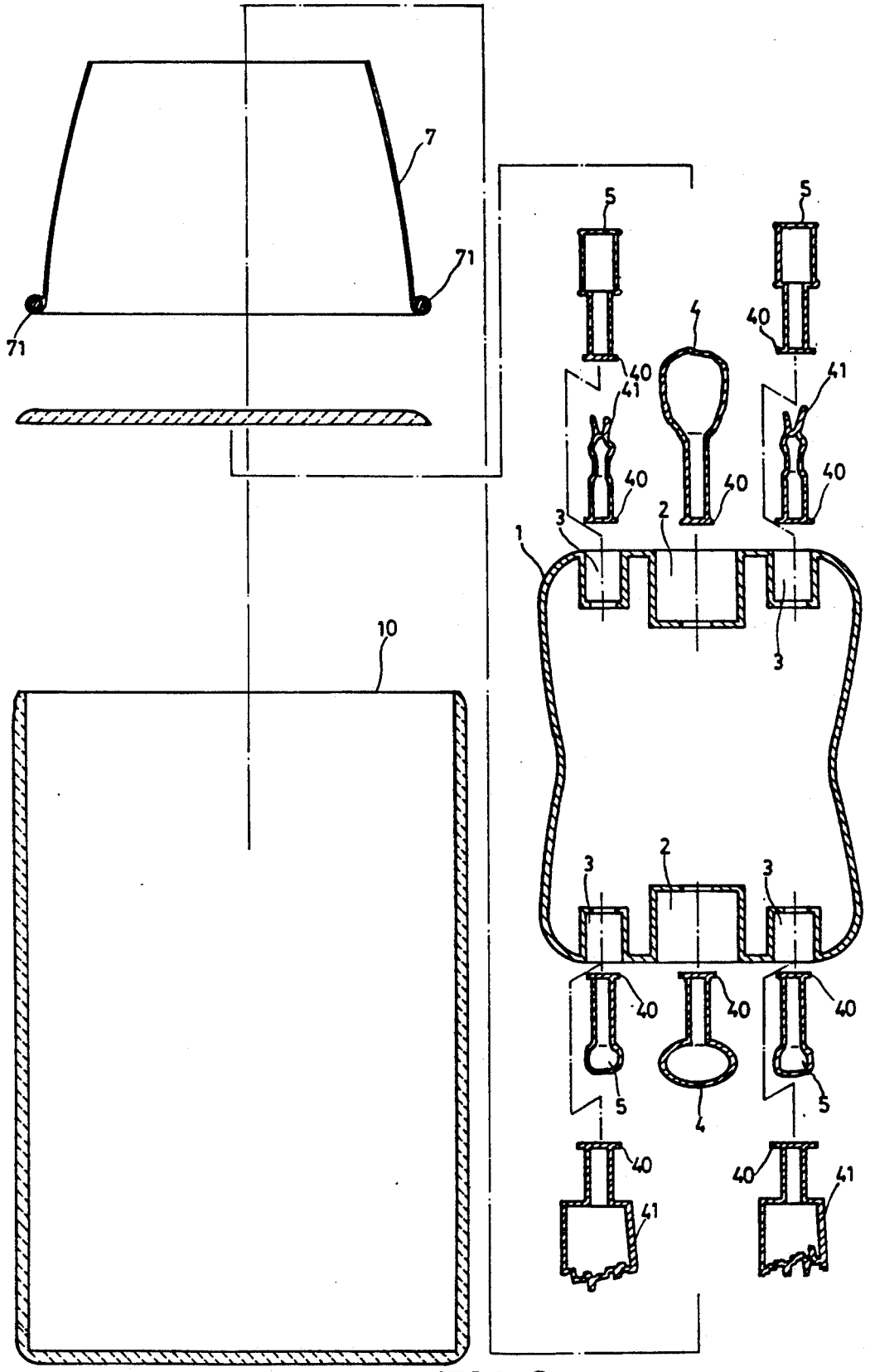
FIG. 2 is an exploded sectional view of the floating body, and the floating and sinking objects associated therewith.

With initial reference to FIGS. 1 and 2, a structure of the amusing floating gadget according to the invention is illustrated therein. The structure includes a container 10 that is filled with fluid. A sealed floating body 1, which can be of any shape, is placed within container 10 and includes a main countersunk hole 2 and a plurality of auxiliary countersunk holes 3 at the top and bottom portions of the body 1. The longitudinal side configuration of body 1 corresponds to the inner space of the container 10 and has considerable buoyancy.

Main countersunk holes 2 on the top and bottom portions of body 1 are each provided with a main floating object 4 of various forms. Each of the auxiliary countersunk holes 3 is provided with a subsidiary floating object 41 corresponding to the main floating objects 4 and are positioned therearound at a predetermined number of locations. Since the buoyancy of floating objects 4 and 41 is greater than that of floating body 1, an opposite movement, i.e., objects 4 and 41 float up and extend out of body 1, is naturally produced. While body 1 floats up, objects 4 and 41 in holes 2 and 3 extend outwardly from body 1. However, each of bodies 4 and 41 is provided with an outwardly extending fender 40 around its bottom edge for latching against a bottom peripheral edge of its corresponding hole 2 or 3. This permits objects 4 and 41 to be retained to body 1 while in their fully extended position. Thus, objects 4 and 41 shall not separate from body 1.

The remaining countersunk holes 3 are each provided with a sinking object 5 which correspond to main and subsidiary floating objects 4 and 41 in design. Objects 5 have a greater density than the fluid and thereby sink under gravity while body 1 floats upwardly. Each of sinking object 5 is provided with a fender 40 at its top portion for preventing objects 5 from separating away from body 1 when objects 5 have sunk to their fully extended position.

The middle outside section of floating body 1 is provided with a skirt 7 forming a girdle therearound. Skirt 7 is made of light material and includes an inner edge which is secured to body 1. Skirt 7 also includes an outer edge provided with a circular heavy object 71 having a density greater than that of the fluid. As a result, the upper half part of body 1 is exposed while the lower half part of body 1 is covered by the skirt 7. Whenever container 10 is turned up-side-down, skirt 7 reverses itself due to object 71 sinking downwardly, thus disposing skirt 7 in a second same position. A proper pattern matching the design of body 1 is painted on both the inside and outside surfaces of skirt 7 to express constantly changeable scenes.

The complete construction of the invention is composed of transparent container 10 of any shape, a fluid, a floating body 1, a plurality of main and subsidiary floating objects 4 and 41, a plurality of sinking objects 5 and a skirt 7. The combined buoyancy of body 1 and objects 4 and 41 exceed the downward gravitational force of sinking objects 5, thus permitting body 1 to slowly float upwardly in the fluid of container 10. During the floating movement, the buoyancy of main and subsidiary floating objects 4 and 41 in the main and auxiliary countersunk holes 2 and 3 on the top portion of body 1 is greater than that of body 1, thus permitting objects 4 and 41 to pop out and extend outwardly from body 1, while sinking objects 5 in the remaining countersunk holes 3 at the top portion of body 1 become fully retracted therein and thus are not visible. At this time, the main and subsidiary floating objects 4 and 41 at the bottom portion of body 1 cannot be seen because they are fully retracted within their corresponding main and auxiliary countersunk holes 2 and 3 due to their buoyancy exceeding that of body 1. However, sinking objects 5 at the bottom portion of body 1 drop downwardly and pop out in descending movement to extend outwardly of body 1 under gravity.

Figure 3:
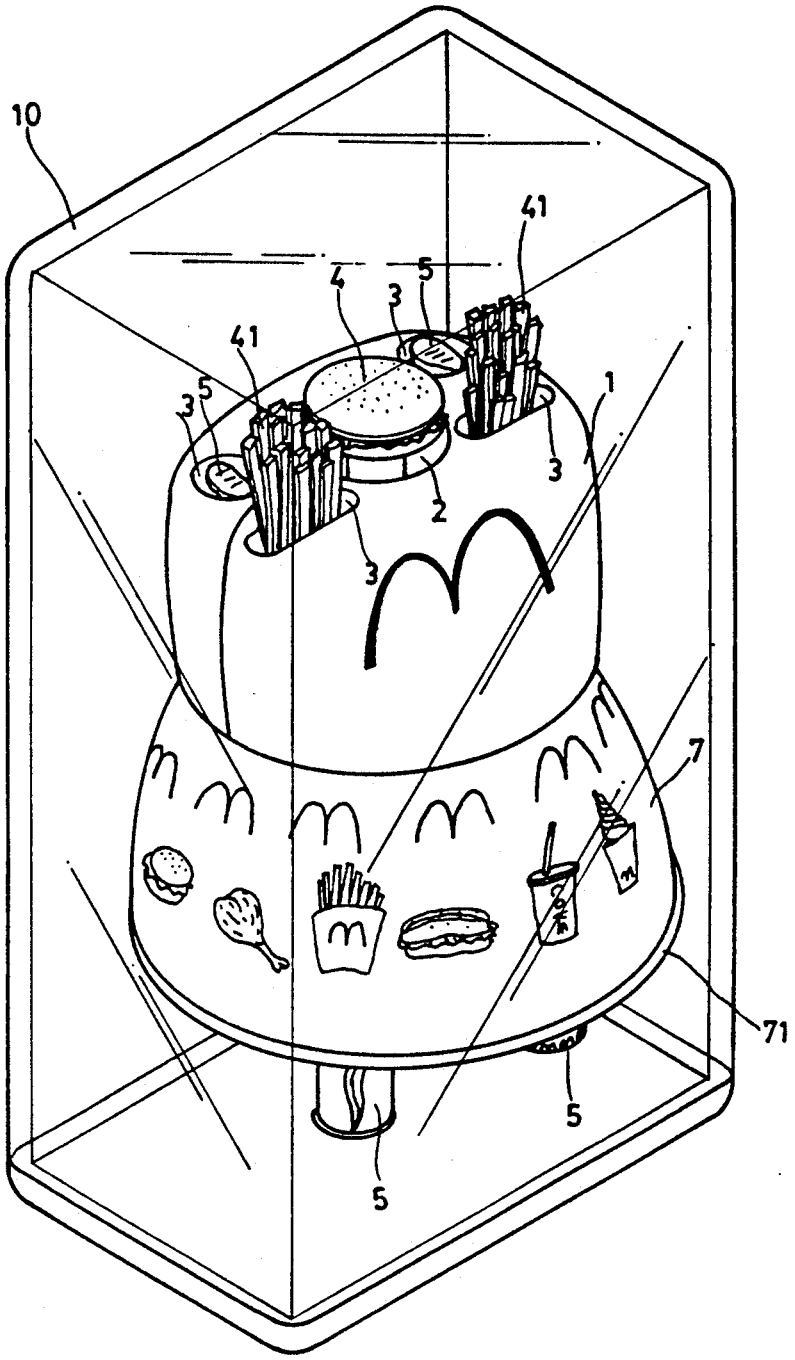
FIG. 3 is a perspective view of the invention.

The above-mentioned floating and sinking movements form an amusing three-dimensional unique scene. When the user turns the container upside-down from that depicted in FIG. 1 to that depicted in FIG. 3, gravitational force is overcome by the buoyancy of body 1 and objects 4 and 41, thereby causing body 1 to float upwardly, thus producing a reverse situation. Floating objects 4 and 41 which popped out in the previous position are now caused to be retracted back into their respective holes 2 and 3, and those which were retracted now pop out.

Figure 4:
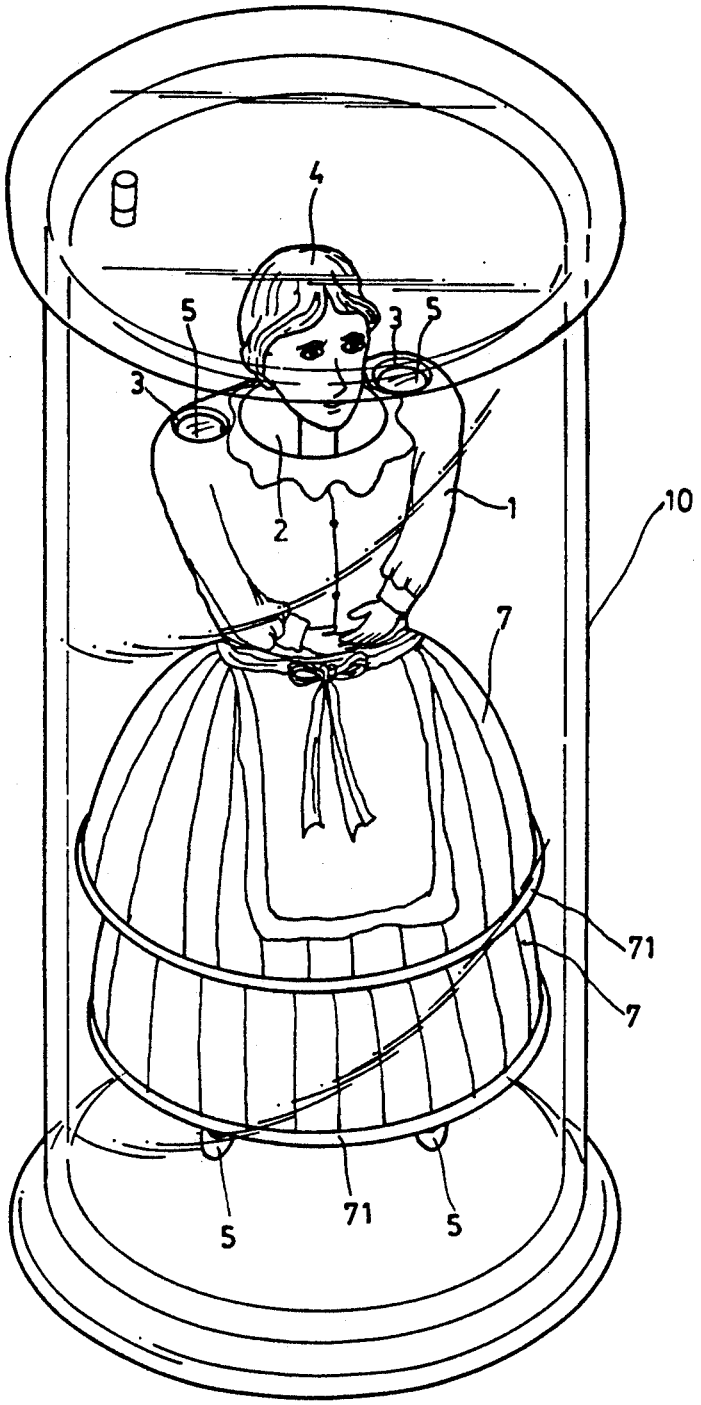
FIG. 4 is another perspective view of the invention.
Figure 5:
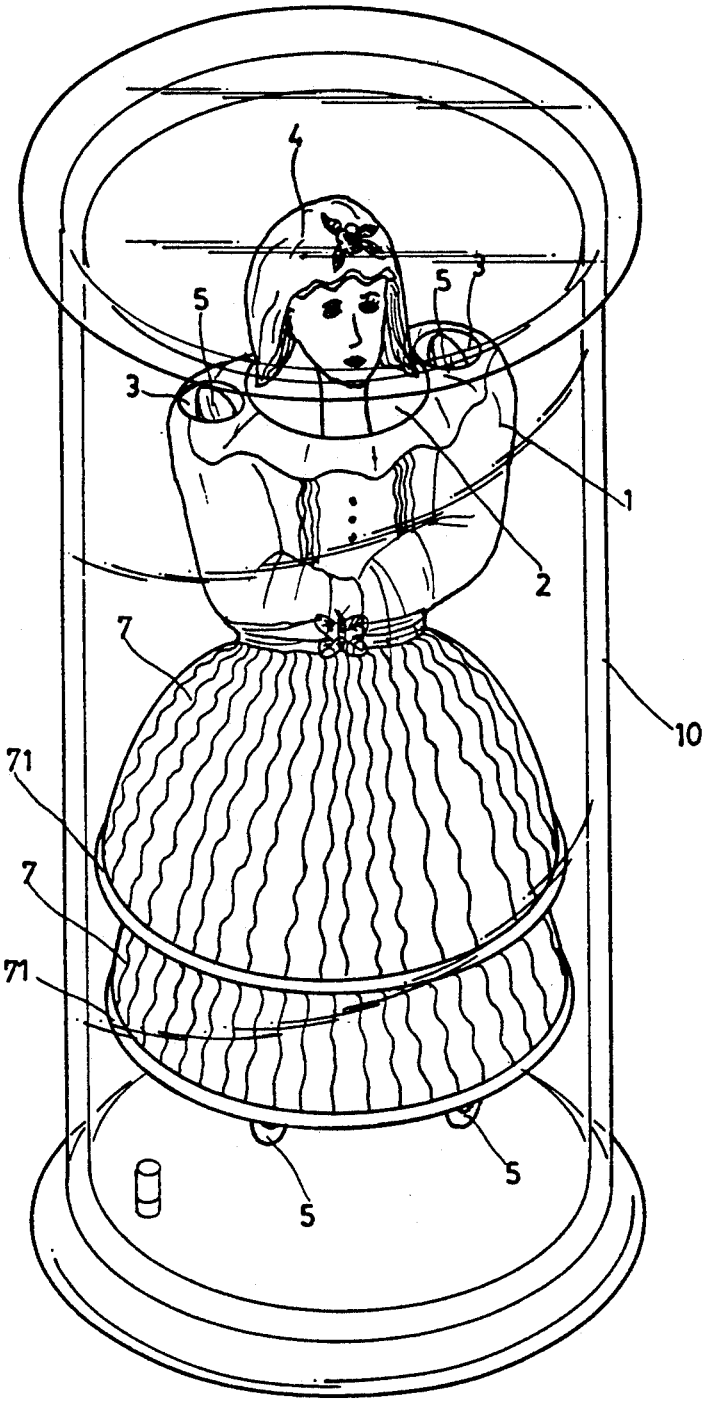
FIG. 5 is yet another perspective view of the invention

The invention forms a lot of different interesting patterns, such as shown in FIGS. 4 and 5. If a multi-layered skirt is used to replace the single-layered skirt 7, more amusement would be obtained. From the illustrations herein, it is obvious that the invention is unique and peerless in its field of technology.

Figure 6:
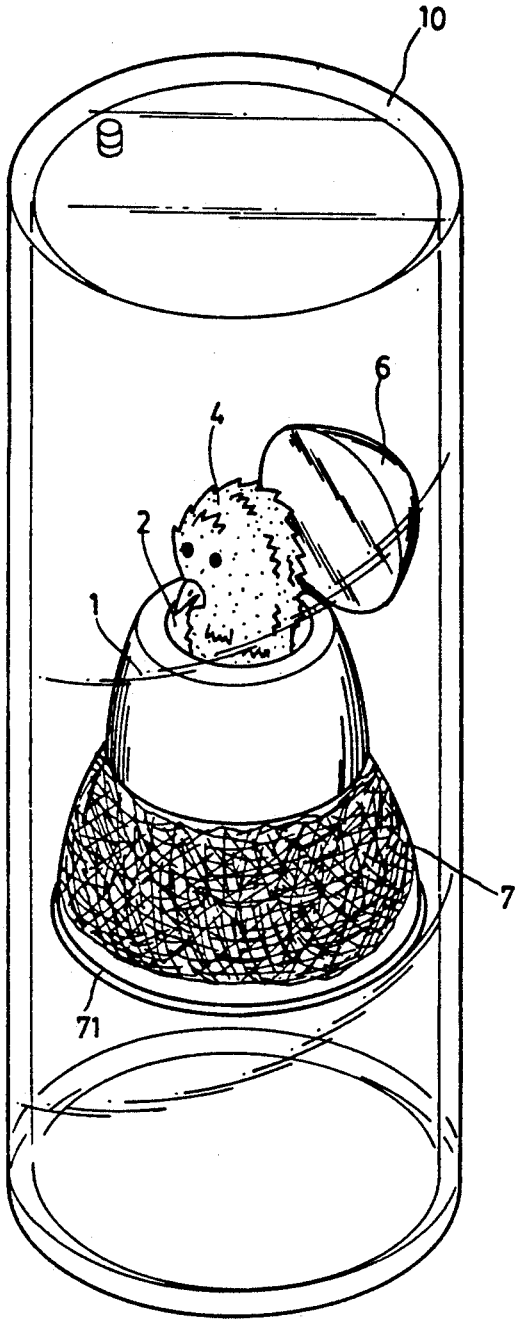
FIG. 6 is a further perspective view of the invention.
Figure 7:
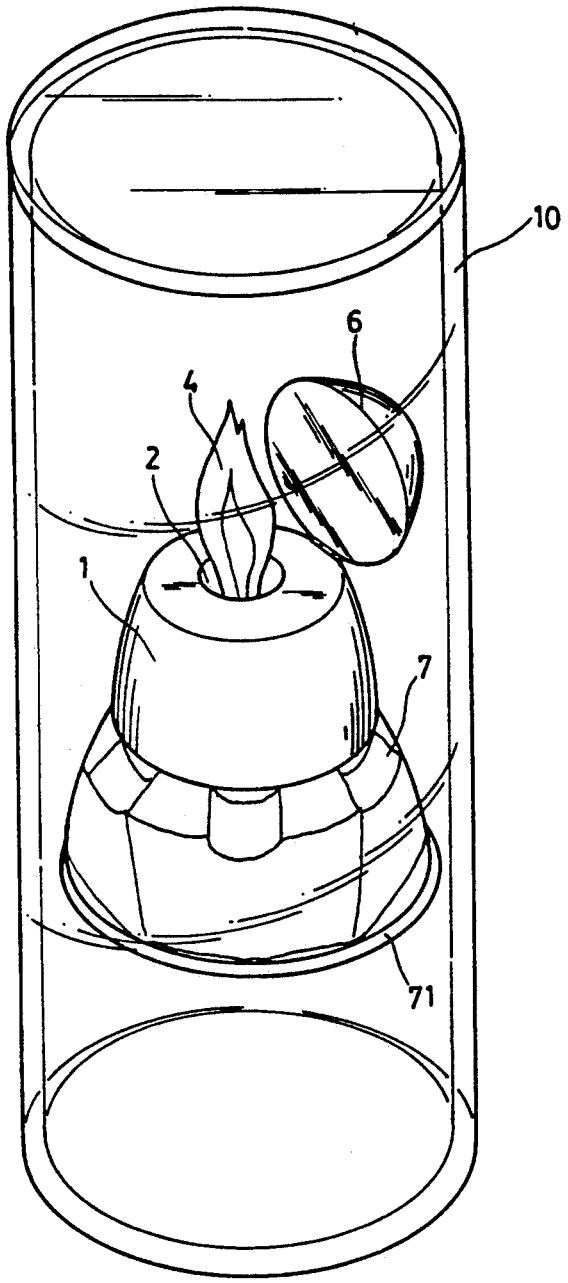
FIG. 7 is a still further perspective view of the invention.

Furthermore, the opposite floating movements of main and subsidiary floating objects 4 and 41, and the floating body 1, can be extended by using a taller container 10 to make different forms, such as those shown in FIGS. 6 and 7. The top and bottom portions of the body 1 can be provided with a cover 6 having one side pivotally attached to body 1. More changes can be produced by combining the cover design with the main floating objects 4 and the main countersunk holes 2. As previously described herein, the upside-down position of the invention will cause reverse movements. More amusement will be obtained from the invention with proper arrangement and materials to yield balance and oneway movement, even when the invention is turned rapidly.

I claim:

1. An amusing floating gadget comprising:

a) a container filled with a fluid;

b) a buoyant body disposed within the fluid and capable of floating upwardly therein when the container is turned upside down;

c) the body including a first end and a second end, each end being provided with a plurality of countersunk holes, with each countersunk hole having a bottom peripheral edge portion;

d) a floating object disposed within each of some of the countersunk holes at both ends of the body, so that during upward floating of the body, the floating objects positioned at the upper end of the body retract outwardly therefrom while the floating objects positioned at the lower end of the body retract inwardly therein, each floating object including a fender for latching engagement with the bottom peripheral edge portion of its corresponding countersunk hole to prevent separation of the floating objects from the body;

e) a sinking object having a density greater than that of the fluid disposed within each of the remaining countersunk holes at the ends of the body, so that during upward floating of the body, the sinking objects at the upper end of the body retract inwardly therein and the sinking objects at the lower end of the body extend outwardly therefrom, each sinking object including a fender for latching engagement with the bottom peripheral edge portion of its corresponding countersunk hole to prevent separation of the sinking objects from the body; and f) a skirt extending around a middle section of the body, the skirt being formed of light material and including an inner edge secured to the body and an outer edge provided with a member having a density greater than that of the fluid, so that the skirt is reversible to always encircle the lower half of the body during upward floating thereof whenever the container is turned upside down.

2. The gadget of claim 1 further including a plurality of skirts extending around the middle section of the body for forming a changeable multi-layered scene.

3. The gadget of claim 1 further including at least one pivotal cover on a countersunk hole at each of both ends of the body for alternatively covering and opening the hole during retraction and extension of a floating object.

* * * * *